United States Patent [19]

Leonaggeo, Jr.

[11] Patent Number: 4,918,766

[45] Date of Patent: Apr. 24, 1990

[54] HYDROTHERAPY EXERCISING DEVICE WITH SCISSOR LIFT TREADMILL

[76] Inventor: Angelo Leonaggeo, Jr., 7 High St., Bedford Hills, N.Y. 10507

[21] Appl. No.: 661,344

[22] Filed: Oct. 16, 1984

[51] Int. Cl.[5] ..... E04H 3/18

[52] U.S. Cl. ..... 4/495; 4/494; 4/504; 4/564; 119/29; 119/158; 272/69

[58] Field of Search ..... 4/494, 495, 504, 564; 119/158, 29; 272/69, 71; 254/122, 124, 9 C

[56] References Cited

U.S. PATENT DOCUMENTS

| | | | |
|---|---|---|---|
| 716,574 | 12/1902 | Nimmo . | |
| 2,611,341 | 9/1952 | Paris . | |
| 3,060,892 | 10/1962 | Schantz . | |
| 3,106,723 | 10/1963 | Carpenter | 4/564 |
| 3,203,670 | 8/1965 | Farris | 254/122 |
| 3,485,213 | 12/1969 | Scanlon | 272/69 |
| 3,543,725 | 12/1970 | Kirkpatrick | 119/158 |
| 3,691,995 | 9/1972 | Little . | |
| 3,935,500 | 2/1976 | Scribner | 4/495 |
| 4,161,925 | 7/1979 | Whitson | 119/158 |
| 4,183,329 | 1/1980 | Leonaggeo, Jr. | 119/158 |
| 4,197,815 | 1/1980 | Brazelton | 119/158 |
| 4,236,489 | 12/1980 | Carra | 119/158 |
| 4,291,646 | 9/1981 | Leonaggeo, Jr. | 119/158 |
| 4,332,217 | 6/1982 | Davis | 119/158 |
| 4,419,776 | 12/1983 | Schmidt | 4/495 |
| 4,574,739 | 3/1986 | Fontaine et al. | 119/158 |

*Primary Examiner*—Henry J. Recla
*Assistant Examiner*—Linda J. Sholl
*Attorney, Agent, or Firm*—Brumbaugh, Graves, Donohue & Raymond

[57] ABSTRACT

An apparatus for exercising and massaging a human, a horse or other animal comprises a tank containing a pool of water, a plurality of water massage jets in the sidewalls of the tank, a cage for retaining the person, horse or animal, a treadmill positioned at the bottom of the case, so that the horse runs on the treadmill while at the same time being treated with a water turbulence massage from the water jet nozzles, and a scissor-like lift device for raising and lowering the treadmill in the pool.

9 Claims, 6 Drawing Sheets

HYDROTHERAPY EXERCISING DEVICE WITH SCISSOR LIFT TREADMILL

BACKGROUND OF THE INVENTION

This invention relates to a water-therapy device which is particularly suitable for animals, more particularly, racehorses, but which may be adapted for human therapy. Specifically, the invention relates to a hydrotherapy exercising device which incorporates a treadmill platform unit attached to a scissor lift for precise, controlled vertical movement within the therapy tub or pool.

My prior U.S. Pat. No. 4,183,329 disclosed the first effective and practical whirlpool therapy facility for relieving injury or soreness in animals, particularly in racehorses. A plurality of whirlpool nozzles are positioned in the sidewalls of the facility for directing a water-air turbulence mixture at a plurality of portions of the horse likely to develop soreness or lameness. A system of skimmers, filters, and water heaters provide a clean, sanitary, and comfortable environment for the animal and, unlike prior devices, filling and emptying of the pool for each use is not required. This device alleviates soreness and also facilitates the recovery of injured animals, particularly racehorses for return to training and racing more quickly.

It has been proposed in the past that for periods of time when horses cannot exercise outside, indoor pools be provided in which the horse can swim. Generally, such pools require sloped entrance ramps for the horse to enter and leave the pool such that the ramps and pool take up a considerable amount of space. Alternatively, the horse can be lowered into a water filled tub to swim in place, but this requires expensive and complicated hoist or hydraulic lifting equipment. Overhead hoists also tend to frighten the horse, are complicated in construction, are difficult to maintain level, and can produce jerking if needed to be stopped and restarted during descent. Similarly, hydraulic lifting equipment is complicated to construct and is costly to maintain.

Aside from these problems, the use of a pool per se has serious drawbacks. First, if the horse is to have an area large enough to swim, the pool requires a significant amount of space, and the pumping, filtering and heating requirements for keeping the pool properly clean and heated are significant. Second, horses are not good natural swimmers, and tending to fear the water, try to reach bottom. This action can lead to injury. Third, swimming pools do not tend to produce useful leg exercise. A horse when in the pool tries to stay afloat by pushing down on its back legs. The muscles used by the horse to try and stay afloat are not those normally used for running. Moreover, the stifle area of the horse can get sore from this swimming movement. Thus, even if the horse is not injured, little, if any, useful leg exercise is accomplished by swimming exercises for horses.

SUMMARY OF THE INVENTION

The present invention is an improved facility and method for exercising and applying hydrotherapeutic treatment to animals, particularly racehorses. In a more simplified form as to the skimming equipment, the invention device can provide excellent water therapy exercise for humans. More particularly, the apparatus according to the invention includes a tank, most preferably rectangular in shape, containing a plurality of water jets in the sidewalls of the tank as known in the art. The jets may be positioned for applying massage directed to areas of the person or animal, e.g. racehorse, likely to develop lameness or soreness. The tank does not require excessive space or amounts of water to be treated, and the water jets can be positioned in close proximity to the horse or person so as to be effective.

The facility employs a hydraulically operated lift scissor-mechanism for raising and lowering a treadmill platform assembly with a retaining cage out of and into the tank, for adjusting the height of the platform during use, or for changing the slope of the platform. The platform is in the form of a treadmill-like, endless conveyor belt, preferably hydraulically driven, which can be operated by a variable speed motor at a selected speed so that the human, horse, or other animal runs on the treadmill during therapy treatment, particularly while at least a portion of the body is immersed.

By employing this device, the person, racehorse or other animal participates in a combination exercise program and water therapy program which conditions the person or animal. Particularly in the case of a racehorse, the invention device builds the horse's "wind" similar to actual racetrack training. Because of the tank design and hydraulic lift mechanism, an effective water therapy massage can be applied such as in my previous patent. In addition, exercise is accomplished without the risk of exacerbating injury or soreness. Since the body of the person or animal, particularly a racehorse, is immersed in water, natural buoyancy relieves much of the weight of the injured, lame or sore legs. Accordingly, as a racehorse runs on the treadmill, it does not experience the pounding and stress on the leg joints and muscles that would occur if the horse were running on a track. Accordingly, the horse can be exercised even when lame or sore, and immediately after racing. Moreover, even when the horse is not injured, the horse may undergo a regular exercise program indoors without risking injury to the joints or muscles.

As part of the exercise program, the platform and thereby the treadmill may be raised or lowered, to either increase or decrease the effective weight of the horse on the treadmill. In all cases, however, the horse will be standing on the treadmill, and will not have to try to swim to stay afloat. Accordingly, the horse will not become scared as may happen in a more open swimming pool environment.

The hydraulically operated scissor light mechanism supports and stabilizes the platform and treadmill as it is raised and lowered from the tank. The mechanism enjoys the advantages of quiet running, stable and uniform descent or ascent, and the capability of stopping at various heights, without jerking motion as may occur with a hoist-type or pulley mechanism. There are no overhead pulleys, hoists or other moving mechanisms surrounding the horse which could tend to frighten the horse. Also, the hydraulic lift mechanism may provide the capability of sloping the treadmill when immersed to simulate uphill running.

In this device, as opposed to swimming pools and some hoist tank arrangements, the horse mounts the treadmill, but never sees the water until the platform begins its descent. in the even, slow descent, the water level rises only gradually, and if at any stage of the process the horse becomes frightened, the scissor lift mechanism has the capability of stopping while the horse becomes accustomed to the water level. During the entire descent, the horse remains standing on the stationary treadmill, and is never required to swim. In addition, at the option of the trainer, the treadmill device may be operated simultaneously with raising and lowering the platform.

For a better understanding of the invention, reference is made to the following detailed description of the preferred embodiments, taken in conjunction with the drawings accompanying the application.

DETAILED DESCRIPTION OF THE PREFERRED EMBODIMENTS

Figure 1:
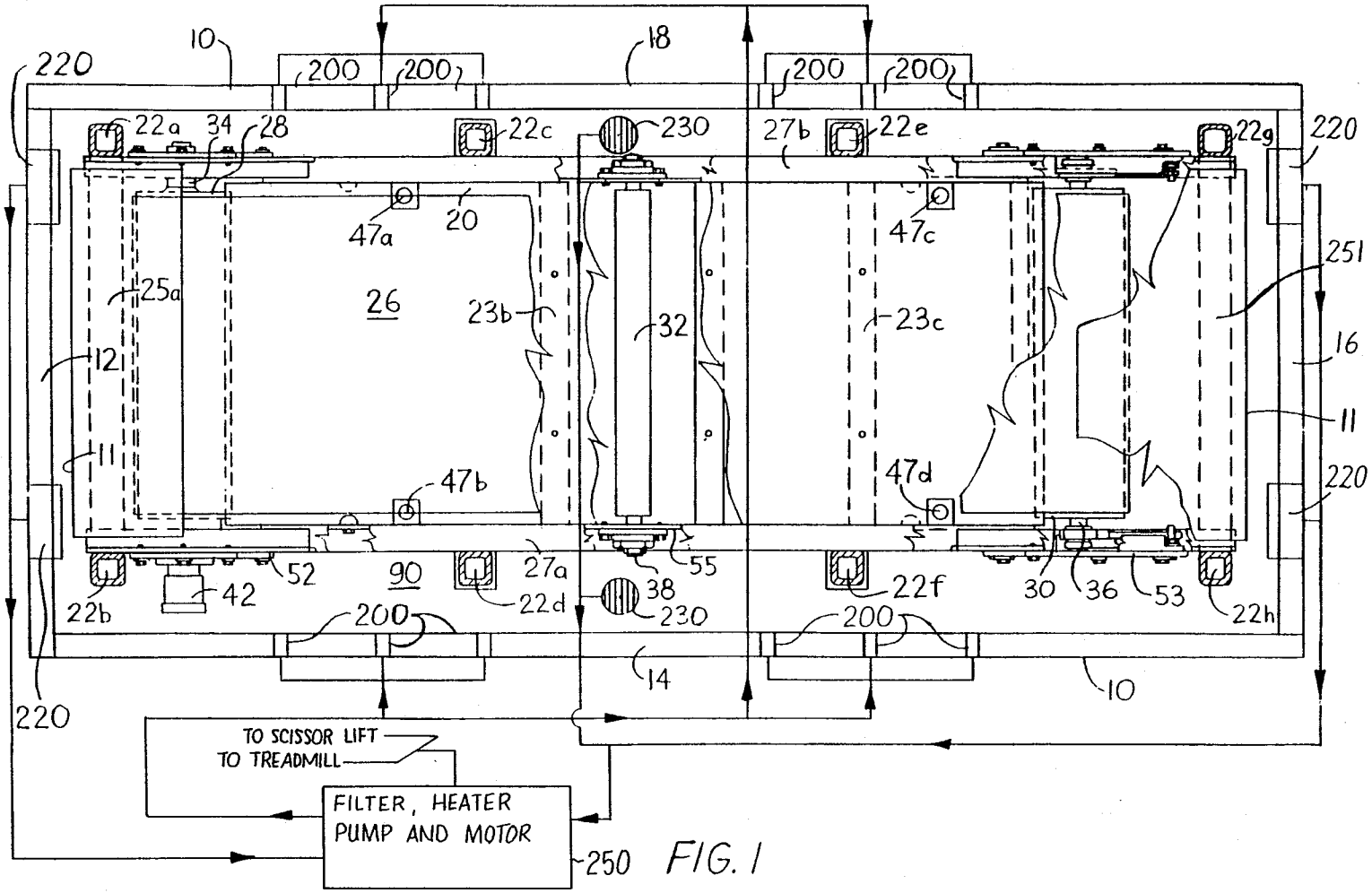
FIG. 1 is a top sectional view of an exercise and whirlpool therapy facility, in schematic form, in accordance with the invention.
Figure 2:
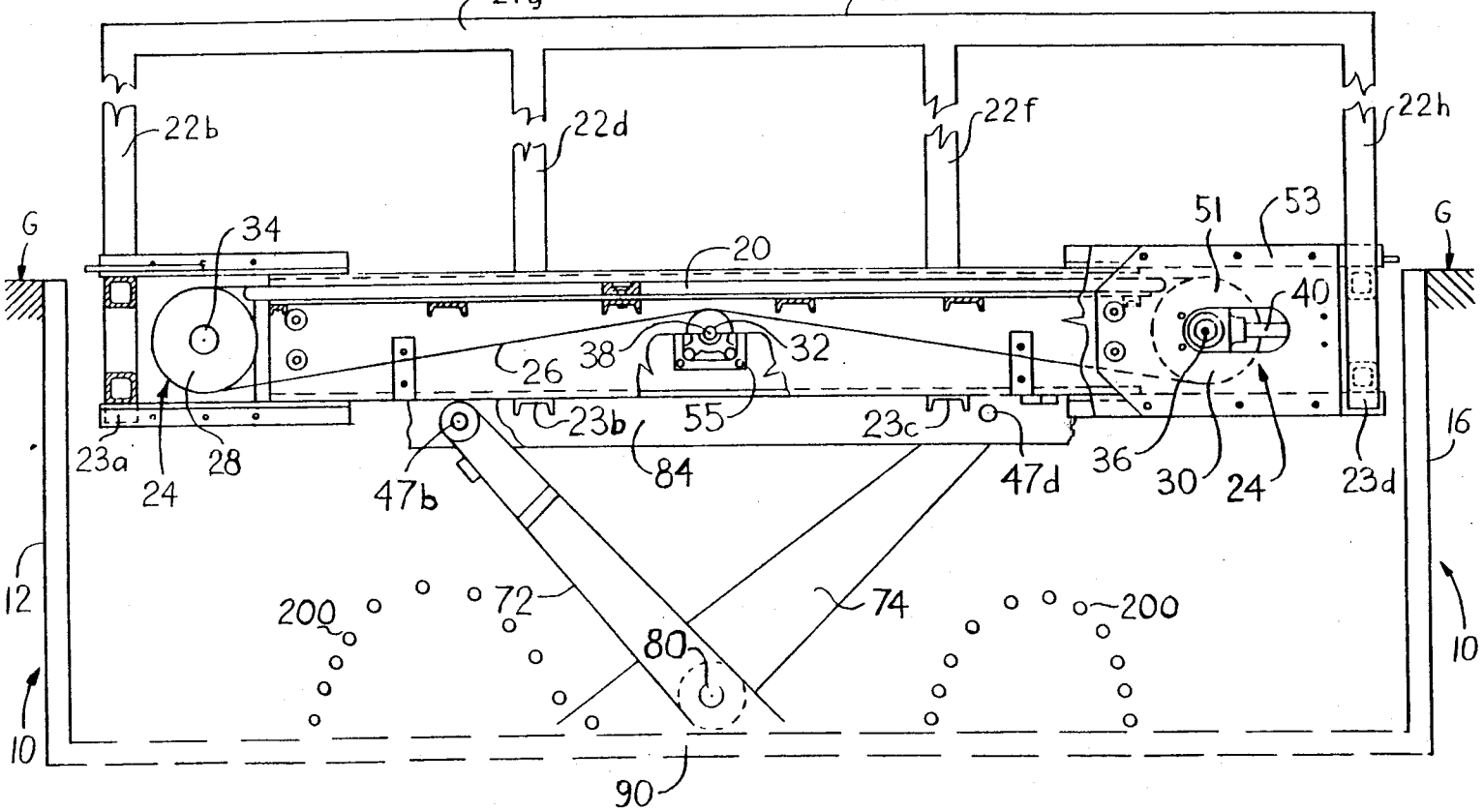
FIG. 2 is a side sectional view of the treadmill assembly of the facility shown in FIG. 1.

As shown in FIGS. 1 and 2, a whirlpool exercise and therapy facility for a racehorse in accordance with the invention includes a generally rectangular tank 10 for containing a body of water and a movable treadmill assembly 24 and platform structure 20 including a retaining cage 11 which may be raised from or lowered into the well of the tank 10.

Figure 5:
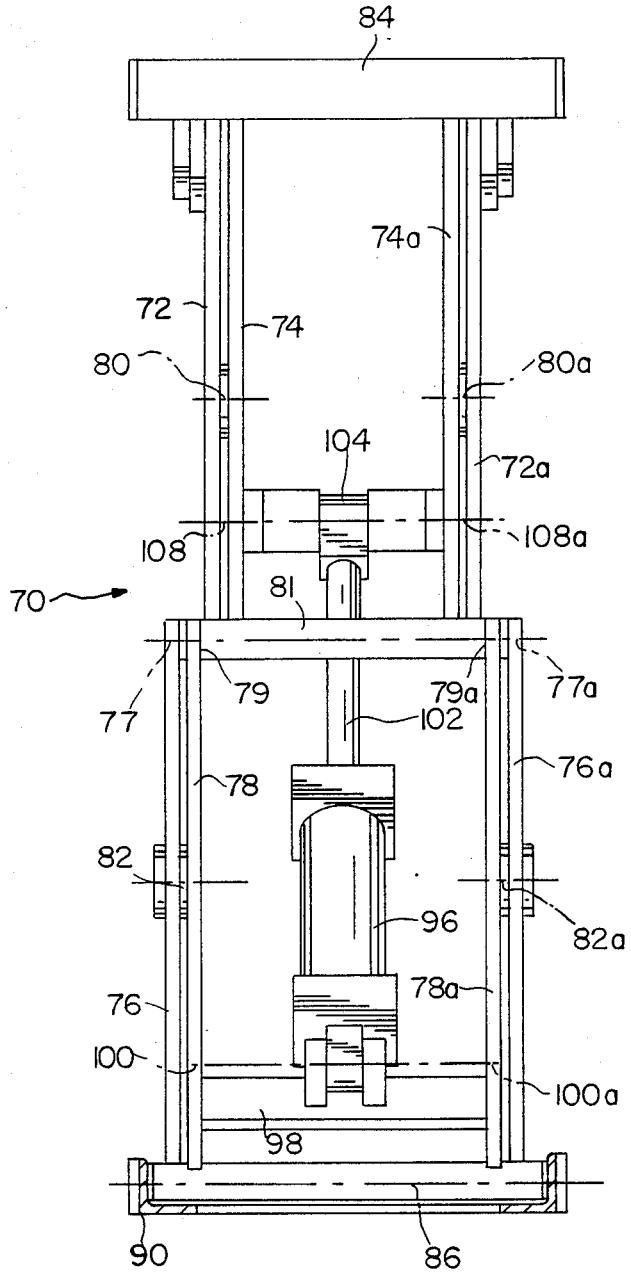
FIG. 5 is a sectional elevated view of the scissor lift of FIG. 4, showing the hydraulic lift mechanism for the treadmill platform.

The tank 10 includes opposed upright sidewalls 14 and 18, a front wall 12, a back wall 16 and a bottom wall 90 (shown in FIG. 5). The tank 10 is sized so that a horse may be immersed from approximately its back down without requiring the horse to swim. The elongated sidewalls 14 and 18 are straight and parallel and spaced apart by a selected distance, preferably only slightly greater than the width of the cage 11. Preferably, the end walls 12 and 16 are spaced apart a distance slightly longer than the length of the cage 11 to minimize the water requirements of the tank 10. The cage 11 is appropriate in size to accommodate a racehorse of average size and the cage 11 is equipped with straps to contain any size horse. The height of the sidewalls 14 and 18 and end walls 12 and 16 of the tank 10 is selected so that, with the platform structure fully descended, it enables an average water depth sufficient to reach at least slightly above the haunches of a large racehorse. This depth has been found empirically to be approximately 6 feet from the bottom of the tank defined by the treadmill platform 24, and it enables adequate therapeutic treatment of the lower back and shoulder muscles of the horse. The sidewalls themselves may extend to any convenient height above the horse, although when the walls extend approximately 5½ feet above the treadmill platform 24 at its lowest depth, persons located above the horse at the side of the tub can control the horse's head and thereby position, and if necessary calm the horse during the exercise session. Accordingly, a typical tank may be 8 feet deep, 12 feet long, 52 inches wide.

The tank 10 is constructed of sturdy fiberglass, or may be made from welded steel plates. The tank is intended to be installed in the ground, with the top of the tank sides 12, 14, 16 and 18 at approximately ground (G) level. A modular-type construction, using either steel or fiberglass panels, facilitates on-site, in ground assembly, although other construction techniques may be utilized such as complete pre-assembly. Each of the sidewalls 14 and 18 of the tank 10 are provided with a plurality of hydrojet nozzles 200. The nozzles may be arranged in a suitable formation to accommodate human or animal use, such as in a generally inverted U-shaped pattern, as described in my prior patent, to correspond to the legs and sides of a racehorse. But preferably, since it is intended that the person, horse or other animal, such as a race hound, move during the treatment program in this facility, a plurality of spaced jets are provided. Since the sidewalls 14 and 18 are spaced fairly closely to the person or animal, the force and effect of the water jets remain effective. The nozzles are preferably so spaced to provide a forced water jet for massage to the shank, knee, forearm, elbow area, chest, and shoulder of the forward portion of the horse, and with respect to the rear leg, the haunch, thigh, stifle, gaskin, hock, and fetlock and pastern portions of the leg.

The end walls 12 and 16 may also be provided with nozzle jets for creating additional turbulence.

The cage 11 is also generally rectangular in shape and comprises a series of posts **22*a*–22*h*, lateral support members 23*a*, 23*b*, 23*c* and 23*d* and vertical top support members 25*a* and 25*b* and horizontal top support members 27*a* and 27*b*. The cage 11 serves to contain and retain the horse during therapy. The posts as aforesaid of cage 11 define a rectangular enclosure which is fitted with a mesh of wire, textile or other suitable material, to protect the horse and equipment and yet to allow the hydrotherapy to occur unimpeded. Optionally, the cage may be fitted with retaining straps at each end. Moreover, rollers may be provided between channels on the exterior of the cage posts and the tank walls to ensure even and controlled vertical movement of the treadmill-/cage/platform assembly 24**.

In use, water under pressure may be directed through all of the jets, or alternatively may be directed through a specific set of nozzle jets to alleviate a particular area of soreness of the horse. Preferably, if the water circulation system is adequate it is desirable to utilize all of the jets, since this will promote the maximum water circulation, turbulence, filtering and cleaning of the water.

Figure 3:
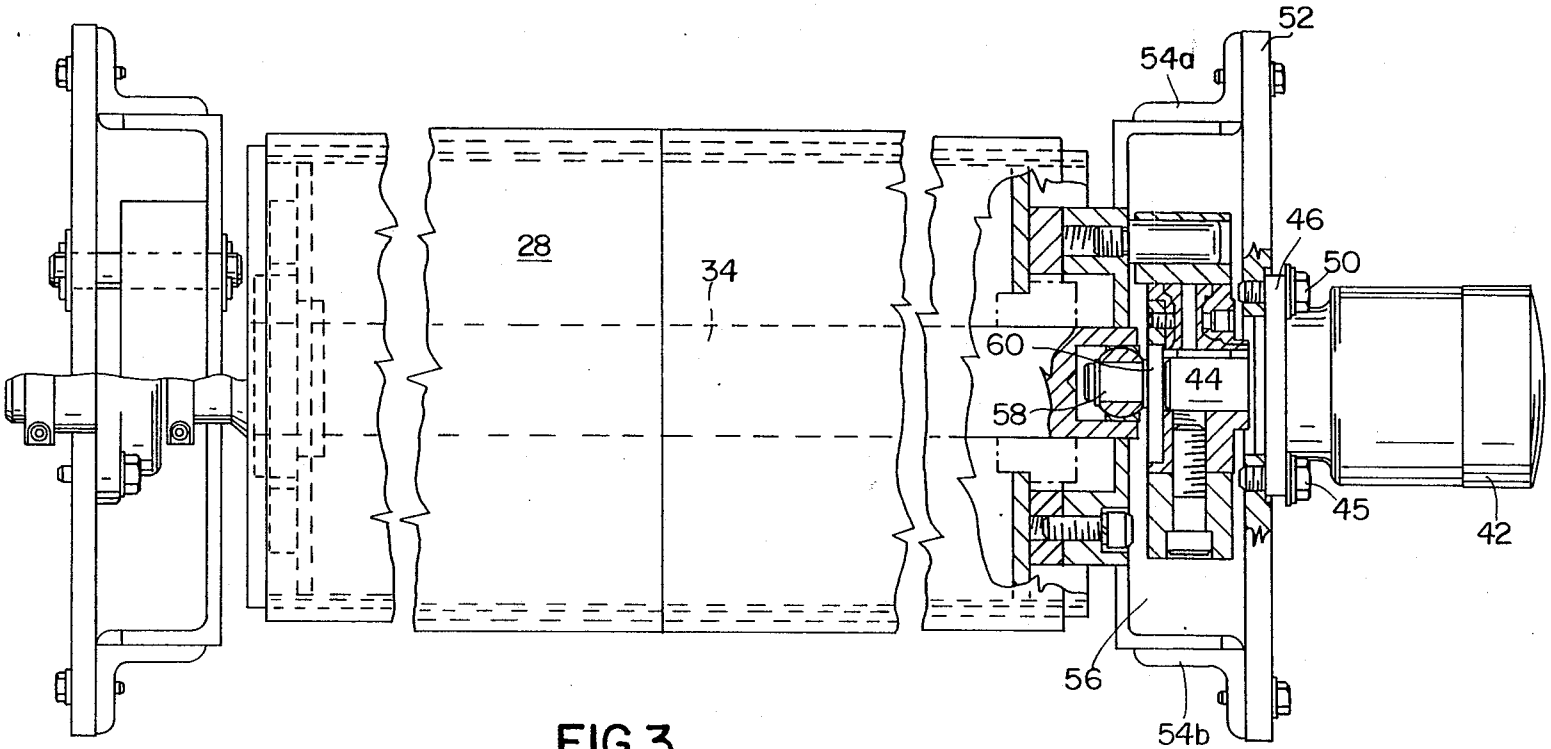
FIG. 3 is a top sectional view of the drive drum section of the treadmill unit taken through lines A—A of FIG. 2, illustrating in schematic form the drive drum and motor assembly for the treadmill platform.

The treadmill-type mechanism 24 includes platform 20 comprising a bed of 32 rollers. As shown particularly in FIG. 2, an endless conveyor belt 26 is wrapped around a pair of end pulleys or drums 28 and 30, and supported along its length by a single roller or plurality of rollers 32. The axles 34 and 36 of the drive drum 28 and the receiver drum 30, respectively, extend between the end post walls of the cage 11 and are attached thereto by plates **52–52*a* and 53–53*a*, respectively. Similarly, the axle 38 of the idler drum or roller 32 extends between the middle walls and is attached to the cage by plates 55 and 55*a*. As best seen in FIG. 3, one of the drums, for example drum 28, acts as the driving drum for the endless belt 26. A pair of flexible hydraulic lines including a pressure hose and return hose (not shown) extend from a high torque, low speed hydraulic motor 42 to an engine (not shown) having a hydraulic pump which supplies the pressurized fluid to the motor 42**.

Figure 4:
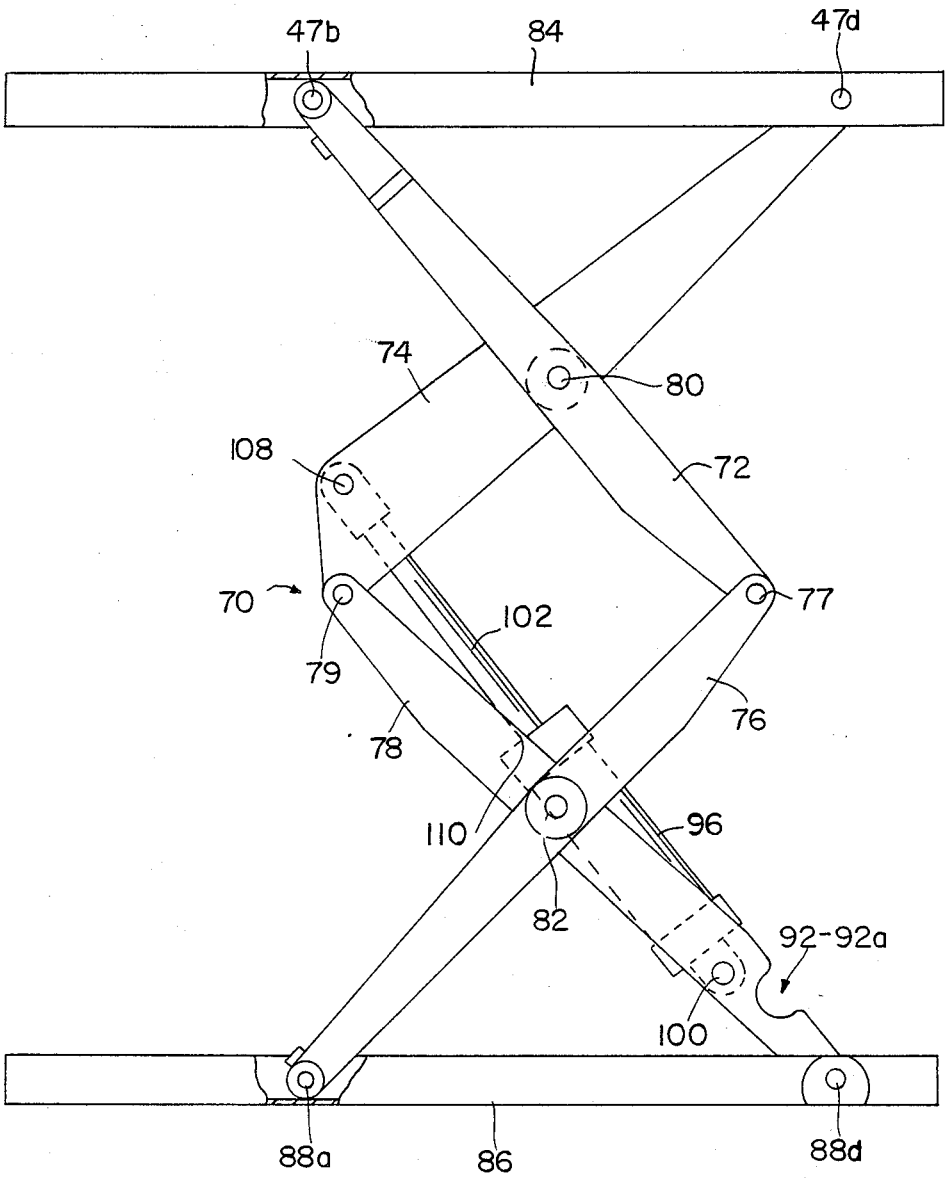
FIG. 4 is a side view of the hydraulically operated scissor lift for the platform of the facility in full elevation.

The drum 28 is supported about the axle 34 and is coupled to the output shaft 44 of the motor 42. The rotatable output shaft 44 is driven by the flow of hydraulic fluid from the pressure hose which is sufficient in length to permit the treadmill to be lowered fully into the tank by virtue of its attachment to the scissor lift device 70 as shown in FIGS. 4 and 5 and as discussed in further detail in connection therewith. The drive drum/motor assembly operates in a novel and efficient manner. The motor 42 is mounted onto plate 46 which is bolted at 45 and 50 to support plate 52 which in turn is bolted to angles 54*a* and 54*b* which are welded to the output shaft and coupler housing 56. Housing 56 contains the output shaft 44 and the bearings and connectors which are attached to the drive shaft 60 of the drive drum axle 34. The rate of fluid delivery from the motor 42, and thereby the velocity of the moving conveyor belt 26, is regulated by a pump control mechanism so that the exercise rate of the horse can be controlled.

The receiver drum 30 is fitted with a horizontal adjustment device 40 in order to allow for controlling the tension on the treadmill belt. Accordingly, plates 53–53*a* are provided with a suitable opening 51.

The platform/treadmill unit also includes a pair of upright thin rods (not shown) near the forward and rear ends of the structure. The rods may support a pair of harnesses which are installed to keep the horse in place on the treadmill. The harnesses may be similar to those that are commonly used as stall guards, which are formed out of hard rubber, and placed approximately chest high, front and back, mounted on support rings on the rods.

Each of the end walls 12 and 16 of the tank is provided with a plurality of preferably wide mouth skimmers 220, which act in a known way to clean the surface of the water or dirt, debris, and other substances that foul the water. The flow rate of the skimmers can be adjusted as desired, between approximately 5 gallons per minute and 50 gallons per minute. One or more main drain outlets 230 are preferably provided in the bottom of the tank to facilitate water recirculation and filtering in a known way. The connecting lines of the drains as well as the output lines from the skimmers, are so connected that water is pumped through a filtering device and water heater shown generally in FIG. 1 as 250. The particle separator effectively removes heavy debris extracted from the water through the skimmers or main drains. The liquid output from the separator passes through one or more filter tanks of known variety. The filters act to remove fine debris which is able to pass through the particle separator. Prior to re-introduction into the tank, the filtered water circulates through a conventional water heater which is designed to keep the water entering the tank, when desired, at approximately 80° to 110° F. It is understood that the tank water may be kept at ambient or refrigerated temperature and may be salt water.

In accordance with the invention, water injected into the tank to create the therapeutic whirlpool turbulence is mixed at the nozzle head with air to produce millions of tiny pulsating bubbles for gently massaging the horse's body. Suitable air induction nozzles are manufactured by Hayward Inc. or by Jacuzzi Brothers Inc., the latter known as Hydro-Air water massage inlet fittings. Such fittings are commonly employed in swimming pools and health spa whirlpool installations.

The piping arrangement for supplying water to the hydrojet nozzles may be that described in my prior U.S. patent, to group together independently fed and controlled systems of upper and lower nozzles. Also, rather than feeding the re-circulated water to the nozzle jets, water may be provided to the nozzle from separate inlets in the side of the pool as described in my prior patent. In this case, feed pipes would introduce the recycled, heated water back into the tank through openings in the sides of the tank.

The hydrojet nozzles operate in a known manner to entrain air at atmospheric pressure through means of an internal venturi (not shown), thereby to provide the desired mixture of air and water at the nozzle outlet. Moreover, by employing this novel air delivery conduit system, that is by decreasing the conduit size to nozzles further away from where the conduit opens into atmosphere, it has been found that the nozzles are induced to draw in equivalent amounts of air, so that the issuing jet is equally aerated.

Figure 6:
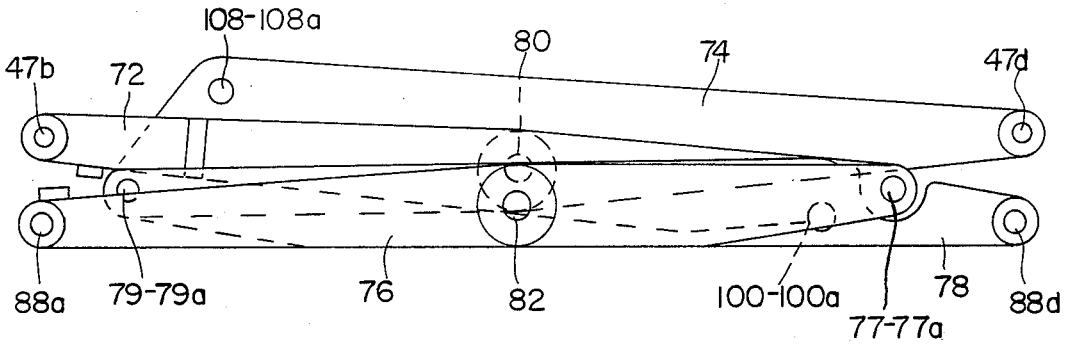
FIG. 6 is another view of the scissor lift mechanism fully closed as it would rest on the tank bottom.

The treadmill mechanism 24 including the roller platform 20 and cage 11 as shown in FIG. 2 is lowered and raised within the tank 10 by means of a hydraulically operated scissor lift device 70, as shown in FIGS. 4 and 5. The lift 70 comprises four pairs of scissor arms, two upper and two lower. The two upper arm pairs are designated 72–74 and 72*a*–74*a* while the two lower arm pairs are 76–78 and 76*a*–78*a*. The upper arm pairs and lower arm pairs are in parallel (as best seen in FIG. 5) and operate in tandem. Upper arms 72 and 74 are connected to each other at pivot point 80. Upper arms 72*a* and 74*a* are connected at point 80*a*. Lower arm pairs 76 and 78 and 76*a* and 78*a* are similarly connected and pivot about pivot points 82 and 82*a*, respectively. Upper arms 72 and 72*a* are connected to lower arms 76 and 76*a*, at pivot points 77 and 77*a*, respectively, and upper arms 74 and 74*a* are similarly connected to lower arms 78 and 78*a* at pivot points 79 and 79*a*, respectively, so as to permit both pairs of upper and lower arms to operate in a scissor-like manner. Stabilizer bar 81 is provided to stabilize and support the tandem scissor action of the lift 70. The upper arms 72–72*a* and 74–74*a* are attached to a top plate 84 which is, in turn, connected to the cage 11 at points 47*a*, 47*b*, 47*c* and 47*d* (also shown in FIGS. 1 and 2). Similarly, lower arms 76–76*a* and 78–78*a* are connected to a bottom plate 86 at points 88*a*, 88*b*, 88*c* and 88*d*. The bottom plate 86 is bolted to the bottom 90 of the tank 10. As seen in FIG. 4, the scissor lift is in the fully raised position while in FIG. 6 the same scissor lift is seen in its fully lowered or resting position on the bottom of the tank. Recesses 92–92*a* in lower arm pair 78–78*a*, as seen in FIG. 4, conveniently accept stabilizer bar 81 between pivot points 77–77*a* so as to permit the scissor lift to be folded to its maximum, which is, in the preferred embodiment, less that one foot in height.

It will be seen that in the operation of the scissor lift, the upper arms 72–72*a* at the points of attachment 47*a*–47*b* to the top plate 84 and the lower arms 76–76*a* at the points of attachment 88*a*–88*b* to the bottom plate 86, will move or slide appropriately within the body of the top and bottom plates, respectively, to permit the raising and lowering of the lift.

The hydraulic cylinder 96 is attached to rod or axle 98 which is connected to pivot points 100–100*a*. The piston shaft 102 of the cylinder 96 is attached at point 104 to rod or axle 106 which in turn is connected to upper arms 74–74*a* at points 108–108*a*. In use, the treadmill and platform structure 24 including the cage 11 is raised by forcing fluid into the cylinder unit 96 to extend the piston arm 102 to operate the lift in a scissor-like fashion. Preferably, a hydraulic pump provides fluid from a reservoir to a flow divider valve of a known type which provides an equal volume, rather than equal pressure, of fluid to the cylinder unit 96. The cylinder unit 96 is provided with a water proofing seal 110 which acts to preclude oil from escaping from the cylinder and, conversely, tank water from entering the cylinder 96.

Once the horse is on the treadmill assembly 24 within the cage 11, and the front and rear harnesses are attached, the hydraulic pump which operates the cylinder 96 may be reversed or released so that the treadmill assembly 24 including cage 11 begins to descend into the water. As the horse is lowered into the water, the increased buoyancy tends to reduce the weight of the horse standing on the bottom platform. However, the horse is always resting on the bottom and is not required to swim. The assembly 24 may be lowered all the way, or the height off the bottom may be adjusted for the particular horses or to change the weight of the horse resting on the treadmill platform 20. Once the treadmill is at the selected height, the hydraulic motor 42 for the treadmill 24 is operated such that the endless belt 26 begins to move if not previously actuated at the entry height. The speed of the belt can be adjusted to carry out the desired exercise program, in which the horse runs in the water at a desired speed. Simultaneously, the whirlpool jets are operated so that the muscles and joints of the horse receive a pulsating massage. The combination of heat, movement, and massage relaxes tightened muscles and promotes the flow of blood to the injured or sore areas.

By adjusting appropriately the height of the platform, the horse can run with little, if any, pounding on its legs. The device avoids the danger of exercising an injured or sore horse, who if running on track would tend to favor the uninjured leg and thereby risk further injury. In addition, since the horse is always on the bottom, it will not injure its stifle muscles through fright or by trying to reach bottom by extending its legs. The horse does not, therefore, require long recuperation periods after races, after injury or during the off season, and can continue a regular exercise program even while injured without stress to the injured or sore joints and muscles. At the same time the horse keeps its wind and the proper muscles used in racing are exercised.

Inasmuch as some exercise programs in indoor pools have been found to cause cramps or exhaustion when horses are not in good physical condition, if desired, as part of a regulated exercise program, the vital functions of the horse can be monitored during the exercise program so that the horse receives the maximum beneficial activity without risk of exhaustion or over-exertion.

The foregoing represents the preferred embodiments of the invention. Variations and modifications will be apparent to persons skilled in the art, without departing from the inventive concepts disclosed herein. For example, while a single cylinder scissor lift mechanism has been shown, other arrangements are possible using multiple cylinders. Also, other types of drives may be substituted for the hydraulic treadmill drive. Moreover, the entire structure and assembly may be modified in degree and size to accommodate animals other than racehorses or humans. All such modifications and variations are intended to be within the scope of the invention as defined in the following claims.

I claim:

1. Apparatus for exercising and massaging a person, a horse or any animal comprising:

(a) a tank for containing a pool of water having a bottom wall and upstanding sidewalls and end walls:

(b) a cage for supporting the person, horse or other animal in said tank;

(c) a treadmill means forming the cage bottom;

(d) means for driving said treadmill means;

(e) a scissor lift device for raising and lifting the cage and treadmill means, said scissor lift device including two parallel upper pairs of arm members and two parallel lower pairs, each of said arm members having an upper end and a lower end, the upper end of each of said upper arm members being pivotably connected to said treadmill means, the lower end of each of said upper arm members being pivotably connected to a respective one of the upper ends of said lower arm members so as to create a first and a second axis of rotation where said upper arm members meet said lower arm members, said upper and said lower arm pairs being operable in tandem, said lift device further including a stabilizer bar provided so as to span between said parallel tandem arm pairs at the first axis of rotation where said upper arms meet said lower arms;

(f) means for powering the scissor lift device, said scissor lift powering means being connected to said scissor lift device in the area of the second axis of rotation;

(g) a plurality of spaced output nozzles in the said tank walls;

(h) means for injecting water into the pool under pressure through said nozzles to provide turbulence in the pool for massaging portions of the body situated in said tank between said tank;

(i) a filtration system for cleaning and purifying the tank water; and (j) means for powering the filtration system.

2. Apparatus as defined in claim 1, wherein said sidewalls are substantially straight and parallel, and spaced apart a distance slightly larger than that required to contain the cage.

3. Apparatus as defined in claim 1, wherein said filtration system comprises:

at least one drain carried by said bottom wall;

a pump in fluid flow communication with said drain to extract water from the tank;

at least one of a particle separator device and a filtering device through which water is forced by said pump;

optional means for heating said extracted water to a pre-determined temperature after passage through said one device; and means for re-introducing said heated water back into said tank.

4. Apparatus as defined in claim 3, wherein said re-introducing means re-introduces the heated water into said tank through said output nozzles.

5. Apparatus as defined in claim 1, wherein said nozzles comprise a plurality of sets of vertically arranged, hydrojet nozzles, and comprising means for providing air to the nozzles comprising, for each said set, an air conduit opening to atmosphere and a plurality of feed conduits branching off from said air conduit and communicating with a nozzle of said set, and wherein in the direction of air flow each respective feed conduit has a diameter smaller than the preceding feed conduit.

6. Apparatus as defined in claim 1, wherein the treadmill driving means comprises means for adjusting the speed of said treadmill means.

7. Apparatus as defined in claim 1, wherein the scissor lift device is actuated by at least one high torque, low speed hydraulic piston and cylinder unit.

8. Apparatus according to claim 1 wherein the drive means for the treadmill, the power means for the scissor lift, the water injection means, and the powering means for the filtration system are operated from a single power source.

9. Apparatus according to claim 8 wherein the power source is a diesel or gas engine connected to a hydraulic motor or pump means to operate all functions of the apparatus.

* * * * *